US007251432B2

(12) United States Patent
Yoneda et al.

(10) Patent No.: US 7,251,432 B2
(45) Date of Patent: Jul. 31, 2007

(54) SYSTEM FOR COLLECTING AN UNFIXED DEVELOPER WITH AN AIRFLOW

(75) Inventors: Yoshiharu Yoneda, Nara (JP); Masanobu Deguchi, Kashiba (JP); Hiroshi Kida, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 42 days.

(21) Appl. No.: 11/207,326

(22) Filed: Aug. 19, 2005

(65) Prior Publication Data

US 2006/0045585 A1 Mar. 2, 2006

(30) Foreign Application Priority Data

Aug. 24, 2004 (JP) ..... 2004-243723

(51) Int. Cl.
*G03G 21/20* (2006.01)

(52) U.S. Cl. ..... 399/92; 399/327

(58) Field of Classification Search ..... 399/92, 399/98, 99, 122, 320, 326, 327, 355; 219/216
See application file for complete search history.

(56) References Cited

U.S. PATENT DOCUMENTS 3,883,292 A * 5/1975 Hamaker ..... 432/60
3,942,889 A * 3/1976 Kurita et al. ..... 399/354
4,509,225 A * 4/1985 Haugen ..... 15/256.51
4,851,880 A * 7/1989 Ziegelmuller et al. ..... 399/355
5,253,025 A * 10/1993 Mitsuya et al. ..... 399/327
5,678,134 A * 10/1997 Miki et al. ..... 399/71
6,453,147 B1 * 9/2002 Morse et al. ..... 399/353
7,072,609 B2 * 7/2006 Karasawa ..... 399/327

FOREIGN PATENT DOCUMENTS

JP 05-119661 5/1993
JP 08-071510 3/1996
JP 11015321 A * 1/1999
JP 2000147936 A * 5/2000
JP 2001109311 A * 4/2001
JP 2002123119 A * 4/2002
JP 2002-304080 10/2002
JP 2004013026 A * 1/2004
JP 2004-191580 7/2004
JP 2004198749 A * 7/2004

* cited by examiner

*Primary Examiner*—Robert Beatty
(74) *Attorney, Agent, or Firm*—Renner, Otto, Boisselle & Sklar, LLP

(57) ABSTRACT

The invention provides a fixing unit including a fixing roller and a pressure roller pressed against the fixing roller inside a housing, for holding and conveying a sheet carrying an image formed by a developer between the fixing roller and the pressure roller thus to fix the image onto the sheet, including a removal section that removes an unfixed developer adhered to the fixing roller or the pressure roller, and an air vent located close to the removal section.

6 Claims, 7 Drawing Sheets

SYSTEM FOR COLLECTING AN UNFIXED DEVELOPER WITH AN AIRFLOW

CROSS-REFERENCE TO RELATED APPLICATIONS

This Nonprovisional application claims priority under 35 U.S.C. §119(a) on Patent Application No. 2004-243723 filed in Japan on Aug. 24, 2004, the entire contents of which are hereby incorporated by reference.

BACKGROUND OF THE INVENTION

1. Field of the Invention

The present invention relates to a fixing unit including a removal unit that removes unfixed developer adhered to a fixing roller or a pressure roller, and to an image forming apparatus including such a fixing unit.

2. Description of the Related Art

An image forming apparatus based on electrophotography forms a desired toner image on a photoconductive drum, and after transferring the toner image on the photoconductive drum to a paper, fixes the toner image onto the paper by a fixing unit. The fixing unit usually includes a pair of heaters. A typical example of the pair of heaters is a fixing roller and a pressure roller disposed so as to be pressed against each other with a paper feeding path held therebetween. This type of fixing unit holds the paper between the fixing roller and the pressure roller, and applies heat and pressure to the paper to thermocompressively fix the toner image onto the paper, thus completing image forming on the paper.

In such a fixing unit, since at least either of the fixing roller or the pressure roller contacts the toner applied to the paper, the toner may adhere to the fixing roller or the pressure roller during the fixing process. Besides, the toner that has adhered to either of the fixing roller or the pressure roller often adheres to the other, via the contact interface therebetween.

To avoid this, for example Japanese Patent Application Laid-Open No. 05-119661 proposes a fixing unit provided with a brush type cleaner disposed so as to contact the fixing roller, to thereby remove the toner adhere thereto.

FIG. 1 is a schematic cross-sectional view showing an internal structure of a conventional fixing unit provided with a cleaner. The fixing unit shown in FIG. 1 includes a fixing roller 201 and a pressure roller 202 inside a housing 200 which constitutes a frame of the apparatus. The fixing roller 201 is a hollow cylindrical-shaped roller including a heater lamp 201*a* therein, which maintains a predetermined temperature of the roller surface. The pressure roller 202 is a cylindrical-shaped roller pressed against the fixing roller 201, so as to provide a fixing nip of a predetermined width with the fixing roller 201. When a paper P to which a toner T has adhered is conveyed to the fixing unit, the fixing roller 201 and the pressure roller 202 applies heat and pressure to the paper P while feeding the paper P held therebetween, to thereby fix the toner image on the paper.

On the circumferential surface of the pressure roller 202, an oil supplier 203, a cleaning roller 204 and a separating blade 205 are disposed. The oil supplier 203 applies an oil to the surface of the pressure roller 202 via an oil applicator 203*a*, for smooth separation of the paper P from the pressure roller 202. The cleaning roller 204 includes a core metal 204*a* and a brush portion 204*b* radially implanted on the core metal 204*a*, to serve to remove the unfixed toner stuck to the pressure roller 202. The separating blade 205 is pressed against the circumferential surface of the pressure roller 202, to peel off from the pressure roller 202 the paper P on which the toner has been fixed. The paper P separated from the pressure roller 202 passes through a paper guide 206 and is discharged outward by a discharge roller 207.

The conventional fixing unit thus constructed utilizes the brush portion 204*b* of the cleaning roller 204 to remove the toner stuck to the pressure roller 202 after the fixing process. However, since a portion of the toner adheres to the brush portion 204*b*, the toner adheres again to the pressure roller via the mutual contact point, when the cleaning roller 204 has made one rotation.

Besides, the brush 204*b* is generally made of a flexible synthetic resin. Accordingly, when the brush portion 204*b* removes the unfixed toner, a portion of the toner may be flipped by the tip of the brush portion 204*b*, thus to splash inside the housing 200. The toner that has splashed not only contaminates the interior section of the housing 200, but also often adheres to the pressure roller 202 and the paper P being conveyed, which leads to degradation in the printed image quality.

BRIEF SUMMARY OF THE INVENTION

The present invention has been conceived in view of the foregoing situation, with an object to provide a fixing unit including a removal section that removes unfixed developer adhered to a fixing roller or a pressure roller, and an air vent located close to the removal section, so as to improve the cleaning performance of removing the unfixed toner and thus to execute a high-quality fixing process, and an image forming apparatus including such a fixing unit.

The fixing unit related to the present invention provides a fixing roller and a pressure roller pressed against the fixing roller inside a housing, for holding and conveying a sheet carrying an image formed by a developer between the fixing roller and the pressure roller thus to fix the image onto the sheet, a removal section that removes an unfixed developer adhered to the fixing roller or the pressure roller, and an air vent located close to the removal section.

According to the present invention, the fixing unit includes a removal section that removes an unfixed developer adhered to the fixing roller or the pressure roller and an air vent located close to the removal section, the unfixed developer removed by the removal section is collected into one location by an airflow passing through the air vent.

The fixing unit related to the present invention has the removal section includes a contacting member, which is provided so as to contact with a circumferential surface of the fixing roller or the pressure roller, and a collection member that collects the unfixed developer adhered to the contacting member, and leads the developer to the collection member with an air flow passing through the air vent.

According to the present invention, the removal section includes a contacting member, which is provided so as to contact with a circumferential surface of the fixing roller or the pressure roller, and a collection member that collects the unfixed developer adhered to the contacting member, the developer adhered to the contacting member is collected into the collection member by the airflow passing through the air vent.

The fixing unit related to the present invention provides the collection member located halfway of the vent path through which the airflow passes.

According to the present invention, the collection member is located halfway of the vent path through which the airflow passes, the developer adhered to the contacting member included in the removal section is collected into the collection member by the airflow.

The fixing unit related to the present invention provides the removal section that has a member for removing the developer adhered to the contacting member.

According to the present invention, the removal section further includes a member that removes the developer adhered to the contacting member, the contacting member can remain constantly cleaned. Also, the developer removed from the contacting member is collected into the collector by the airflow passing through the air vent.

The fixing unit related to the present invention provides the contacting member that is a roller brush.

According to the present invention, since the contacting member included in the removal section is a roller brush, the fixing roller and the pressure roller can be prevented from being damaged on the circumferential surface.

The fixing unit related to the present invention further comprises a driving section that rotationally drives the roller brush.

According to the present invention, a driving section that rotationally drives the roller brush allows effectively removing the developer adhered to the fixing roller or the pressure roller.

The fixing unit according to the present invention comprises the roller brush set to rotate in a reverse direction to a rotating direction of the fixing roller or the pressure roller with which the roller brush is in contact.

According to the present invention, Rotating as above the roller brush in a reverse direction to a rotating direction of the fixing roller or the pressure roller with which the roller brush is in contact can further enhance the removing effect of the developer adhered to the fixing roller or the pressure roller.

The image forming apparatus related to the present invention comprising a reception unit that receives image data, a transfer unit that transfers the image formed by a developer based on the received image data, and a fixing unit according to one of the foregoing aspects of the present invention, so as to fix by the fixing unit the image transferred to the sheet by the transfer unit, thus to complete image forming.

According to the present invention, since a fixing unit according to one of the foregoing aspects of the present invention is employed to fix the image on the sheet transferred thereto by the transfer unit and thus to complete image forming, the circumferential surfaces of the fixing roller and the pressure roller can be constantly maintained effectively cleaned, which results in effective prevention of degradation in the print image quality through the fixing process.

In the present invention, a removal unit that removes the unfixed developer adhered to the fixing roller or the pressure roller, and an air vent located close to the removal section. Accordingly, the unfixed developer removed by the removal section is collected into one location by an airflow passing through the air vent, and thus prevented from splashing inside the housing. Consequently, high-quality fixing performance can be executed.

In the present invention, the removal unit includes a contacting member, which is proveded so as to contact with a circumferential surface of the fixing roller or the pressure roller, and a collection member that collects the unfixed developer adhered to the contacting member. Accordingly, the developer adhered to the contacting member is collected into the collection member by the airflow passing through the air vent, and thus prevented from splashing inside the housing. Consequently, high-quality fixing performance can be executed.

In the present invention, the collection member is located halfway of the vent path through which the airflow passes. Accordingly, the developer adhered to the contacting member included in the removal section is collected into the collection member by the airflow, and thus prevented from splashing inside the housing. Consequently, high-quality image fixing performance can be executed on the sheet.

In the present invention, the removal section further includes a member that removes the developer adhered to the contacting member. Such structure allows maintaining the contacting member constantly cleaned of the developer adhered thereto, and thus preventing the developer from adhering again from the contacting member to the fixing roller or the pressure roller, even when the fixing process is successively executed.

In the present invention, the contacting member included in the removal unit is a roller brush. Such structure allows preventing the fixing roller and the pressure roller from being damaged on the circumferential surface, and hence a stable fixing quality can be maintained.

The fixing unit according to the present invention further comprises a driving unit that rotationally drives the roller brush. Such arrangement allows effectively removing the developer adhered to the fixing roller or the pressure roller.

In the present invention, the roller brush is set to rotate in a reverse direction to a rotating direction of the fixing roller or the pressure roller with which the roller brush is in contact. Such arrangement can further enhance the removing effect of the developer adhered to the fixing roller or the pressure roller.

In the present invention, the image on the sheet transferred thereto by the transfer unit is fixed by the fixing unit according to one of the foregoing aspects of the present invention. Therefore, the circumferential surfaces of the fixing roller and the pressure roller can be constantly maintained effectively cleaned, and the sheet is prevented from being stained by splashing developer. As a result, the present invention effectively prevents the degradation in the print image quality through the fixing process.

The above and further objects and features of the invention will more fully be apparent from the following detailed description with accompanying drawings.

DETAILED DESCRIPTION OF THE INVENTION

Hereunder, the present invention will be described in details based on the drawings illustrating the embodiments thereof.

FIRST EMBODIMENT

Figure 1:
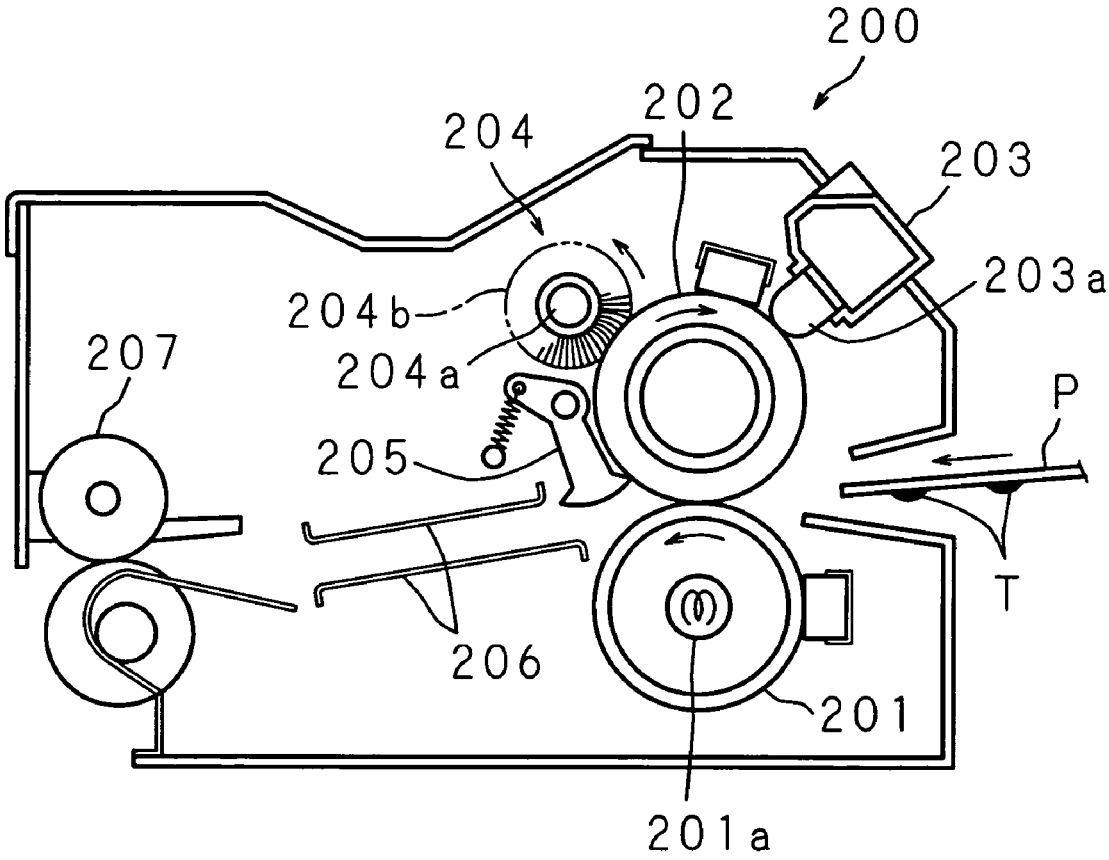
FIG. 1 PRIOR ART
FIG. 1 is a schematic cross-sectional view showing an internal structure of a conventional fixing unit provided with a cleaner.
Figure 2:
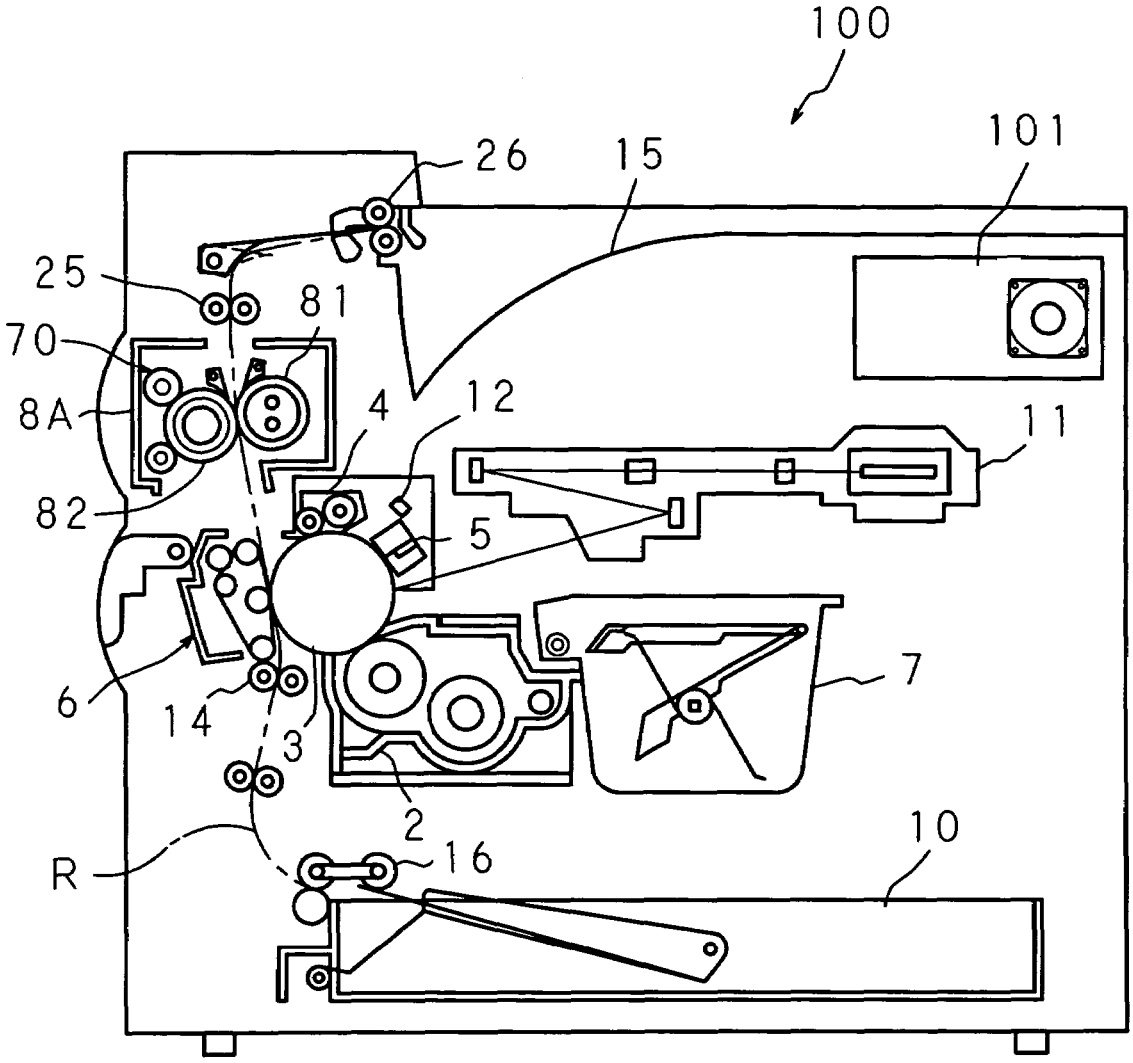
FIG. 2 is a schematic cross-sectional view showing a structure of an image forming apparatus according to the present invention.

FIG. 2 is a schematic cross-sectional view showing a structure of an image forming apparatus according to the present invention. The image forming apparatus 100 according to the present invention includes a paper tray 10 at a lowermost portion thereof, for accommodating therein a sheet such as a paper or an OHP film (hereinafter, simply a paper). The paper tray 10 is provided with a pickup roller for individually supplying each sheet of paper to a paper feeding path R. The paper forwarded through the paper feeding path R is temporarily retained by a resist roller 14. The resist roller 14 starts to feed the paper adjusting a timing so that an image is formed on a predetermined position on the paper.

The image forming apparatus 100 includes an image forming unit based on electrophotography, in which a toner image is transferred onto the sheet supplied by the resist roller 14, and a fixing unit 8A provided posterior to the image forming unit serves to fix the toner image onto the paper, thus completing image forming.

The image forming unit included in the image forming apparatus 100 is provided with a photoconductive drum 3 that carries the toner image to be transferred onto the paper, and a charger 5, an optical scanning unit 11, a developing unit 2, a transfer unit 6, a cleaning unit 4 and a discharge lamp 12 are disposed around the photoconductive drum 3.

The charger 5 charges the surface of the photoconductive drum 3 to a predetermined potential. The optical scanning unit 11 scans an optical image over the surface of the photoconductive drum 3 charged to the predetermined potential, thus to delineate an electrostatic latent image. The developing unit 2 supplies a toner (developer) in a toner container 7 to the electrostatic latent image generated on the surface of the photoconductive drum 3, to form a toner image. The transfer unit 6 transfers the toner image on the surface of the photoconductive drum 3 to the paper forwarded by the resist roller 14. The cleaning unit 4 removes and collects the toner remaining on the surface of the photoconductive drum 3, so that a new toner image can be formed on the photoconductive drum 3. The discharge lamp 12 eliminates the charge on the surface of the photoconductive drum 3.

Figure 3:
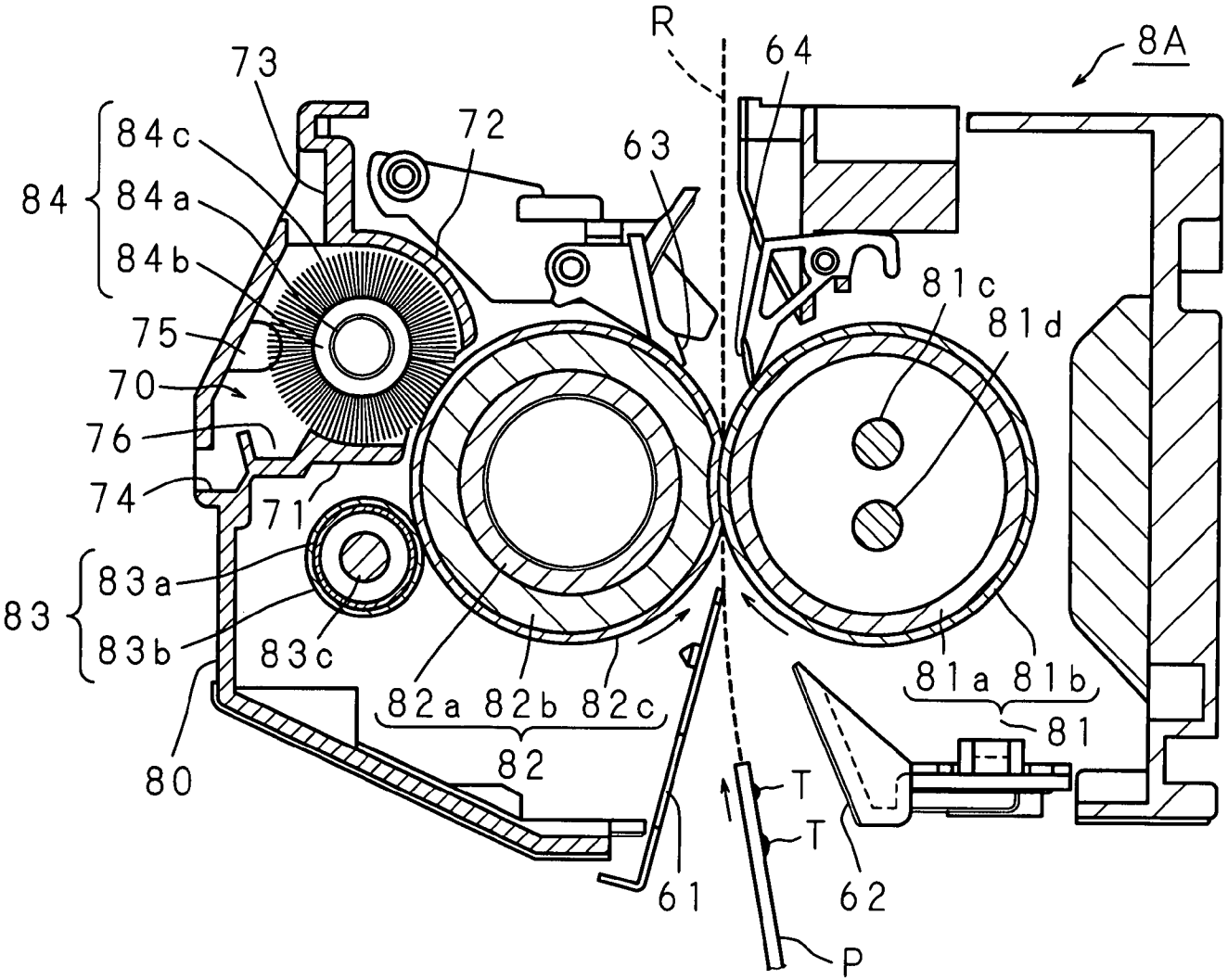
FIG. 3 is a schematic cross-sectional view showing a structure of a fixing unit according to a first embodiment of the present invention.

The fixing unit 8A installed posterior to the image forming unit includes a fixing roller 81 and a pressure roller 82. The fixing roller 81 is controlled to turn heater lamps 81*c*, 81*d* (Ref. FIG. 3) on and off based on a temperature detected by a temperature sensor (not shown), to thereby maintain a predetermined temperature (160 to 200° C., for example). The fixing roller 81 and the pressure roller 82 rotate to hold the paper forwarded thereto, to heat up the surface of the paper so as to fix the toner image by thermocompression onto the paper, and to thus complete image forming on the paper. The fixing unit 8A also includes, in addition to the fixing roller 81 and the pressure roller 82, a cleaning unit 70 that removes the unfixed developer stuck to the pressure roller 82. The details of the cleaning unit 70 will be subsequently described.

The paper on which the toner image has been thermocompressively fixed by the fixing unit 8A is forwarded along the paper feeding path R by a feed roller 25, and discharged to a receiver tray 15 by a discharge roller 26.

The foregoing image forming operation is performed under control of a control unit 101 including a CPU and so on, which controls the action of the respective components.

FIG. 3 is a schematic cross-sectional view showing a structure of the fixing unit according to the first embodiment. The fixing unit 8A includes inside a housing 80 the fixing roller 81, the pressure roller 82, an external heating roller 83 and the cleaning unit 70. The housing 80 may be constituted of a thermosetting resin such as PET (polyethylene terephthalate) or PBT (polybutylene terephthalate).

The fixing roller 81 includes a core metal 81*a* and a separation layer 81*b*, and the core metal 81*a* accommodates therein heater lamps 81*c*, 81*d* that serve as a heat source. The core metal 81*a* may be made of a metal such as iron, a stainless steel, aluminum or copper, or an alloy of such metals. In this embodiment, the core metal 81*a* is constituted of an iron (STKM) in a hollow cylindrical shape, in dimensions of 40 mm in diameter and 1.3 mm in thickness. A reason that the thickness of 1.3 mm is adopted in this embodiment is to restrain a thermal capacity at a low level.

The separation layer 81*b* may be constituted of a fluorine-based resin such as PFA (a copolymer of tetrafluoroethylene and perfluoroalkylvinylether) or PTFE (polytetrafluoroethylene), a silicone rubber, a fluorinated rubber or the like. In this embodiment, a synthetic material composed of PFA and PTFE is applied to the core metal 81*a* in a thickness of 25 μm, to form the separation layer 81*b*.

The heater lamps 81*c*, 81*d* are constituted of halogen heaters, and irradiates an infrared light upon receiving power under control of the control unit 101. The infrared light irradiated by the heater lamps 81*c*, 81*d* heats up the inner circumferential surface of the fixing roller 81 (i.e. the inner circumferential surface of the core metal 81*a*). Also, a temperature sensor (not shown) is disposed close to the fixing roller 81, and the control unit 101 turns the heater lamps 81*c*, 81*d* on and off based on the output of the temperature sensor, to thereby maintain the outer circumferential surface of the fixing roller 81 (i.e. the outer circumferential surface of the separation layer 81*b*) at a predetermined temperature.

The pressure roller 82 is disposed so as to be pressed against the fixing roller 81, at a position opposite thereto across the paper feeding path R. The pressure roller 82 includes a core metal 82*a*, a heat resistant elastic layer 82*b* and a separation layer 82*c*. The core metal 82*a* and the separation layer 82*c* are usually made of a similar material to that of the core metal 81*a* and the separation layer 81*b* of the fixing roller 81. As the heat resistant elastic layer 82*b* a silicone rubber may be employed, and in this embodiment a silicon rubber (rubber hardness according to JIS-A50°) of 6 mm in thickness is employed.

To the pressure roller 82, a biasing force of a predetermined magnitude is applied toward the fixing roller 81 by a biasing member (not shown) such as a pressure spring, so that a fixing nip of approx. 6 mm in width at the contact interface between the fixing roller 81 and the pressure roller 82.

The external heating roller 83 is pressed against a portion of the circumferential surface of the pressure roller 82. The external heating roller 82 includes a core metal 83*a* and a separation layer 83*b*, and the core metal 83*a* accommodates therein a heater lamp 83*c* that serves as the heat source. The core metal 83*a* is of a hollow cylindrical shape of 15 mm in diameter, and the separation layer 83*b* provided around the outer circumferential surface of the core metal 83*a* has a thickness of 25 μm. The core metal 83*a* and the separation layer 83*c* may be made of a similar material to that of the core metal 81*a* and the separation layer 81*b* of the fixing roller 81.

A temperature sensor (not shown) is disposed close to the external heating roller 83, and the control unit 101 turns the heater lamps 81*c*, 81*d* on and off based on the output of the temperature sensor, to thereby maintain the outer circumferential surface of the external heating roller 83 and the pressure roller 82 at a predetermined temperature (130 to 150° C., for example).

When the paper P to which the toner T has adhered is forwarded to the fixing unit 8A configured as above, the paper P is led to the contact interface between the fixing roller 81 and the pressure roller 82 by paper feeding guides 61, 62 located at a lower portion of the fixing unit 8A. The fixing roller 81 and the pressure roller 82 apply heat and pressure to the paper P by holding the paper P therebetween, to thereby fix the toner onto the paper P. The paper P to which the toner has been fixed either spontaneously separates from the fixing roller 81 and the pressure roller 82 because of the separation property thereof, or is peeled off by separating blades 64, 63 disposed so as to be pressed against the fixing roller 81 and the pressure roller 82 respectively, and forwarded to a downstream side of the paper feeding path R (upward from the fixing unit 8A).

When performing the fixing process in this way, a portion of the toner T may adhere to the surface of the fixing roller 81. The toner T thus stuck to the surface of the fixing roller 81 adheres to the pressure roller 82 via the fixing nip. Therefore, the fixing unit 8A according to this embodiment includes a cleaning unit 70 that removes the toner stuck to the pressure roller 82.

The structure of the cleaning unit 70 is as follows. The cleaning unit 70 is located in a space delimited by the housing 80, a lower cover 71 and an upper cover 72, and includes a cleaning roller 84, a projection 75 and a receiving tray 76. The housing 80 is provided with ventilation ports 73, 74 of an appropriate size. One (73) of the ventilation ports 73, 74 is located at a position higher than the cleaning roller 84, and the other (74) is at a lower position than the cleaning roller 84.

The cleaning roller 84 includes a core metal 84*a* disposed parallel to the rotation axis of the pressure roller 82, a cylindrical-shaped base material 84*b* fixed over the circumferential surface of the core metal 84*a*, and a brush portion 84*c* made of a flexible synthetic resin radially implanted on the circumferential surface of the base material 84*b*. The core metal 84*a* may be made of a similar material to that of core metal 81*a* of the fixing roller 81. The base material 84*b* and the brush portion 84*c* may be constituted of a conductive nylon for example, and filaments of 200 to 400 deniers may be employed to constitute the brush portion 84*c*.

The cleaning roller 84 is rotationally driven by a driving unit (not shown) so as to rotate around the core metal 84*a*. The cleaning roller 84 is set to rotate in a reverse direction to the rotating direction of the pressure roller 82, so as to effectively remove the toner stuck to the surface of the pressure roller 82. The driving source of the cleaning roller 84 may be a motor, which may be used in common to also rotate the pressure roller 82, or used exclusively for the cleaning roller 84.

The projection 75 is horizontally erected on the housing 80, such that a tip portion of the projection 75 contacts the circumferential surface of the brush portion 84*c*. The projection 75, which may be integrally formed with the housing 80, is preferably fluorine-coated on the surface. The receiving tray 76 is located below the projection 75, and has an upwardly opened shape.

Figure 4A:
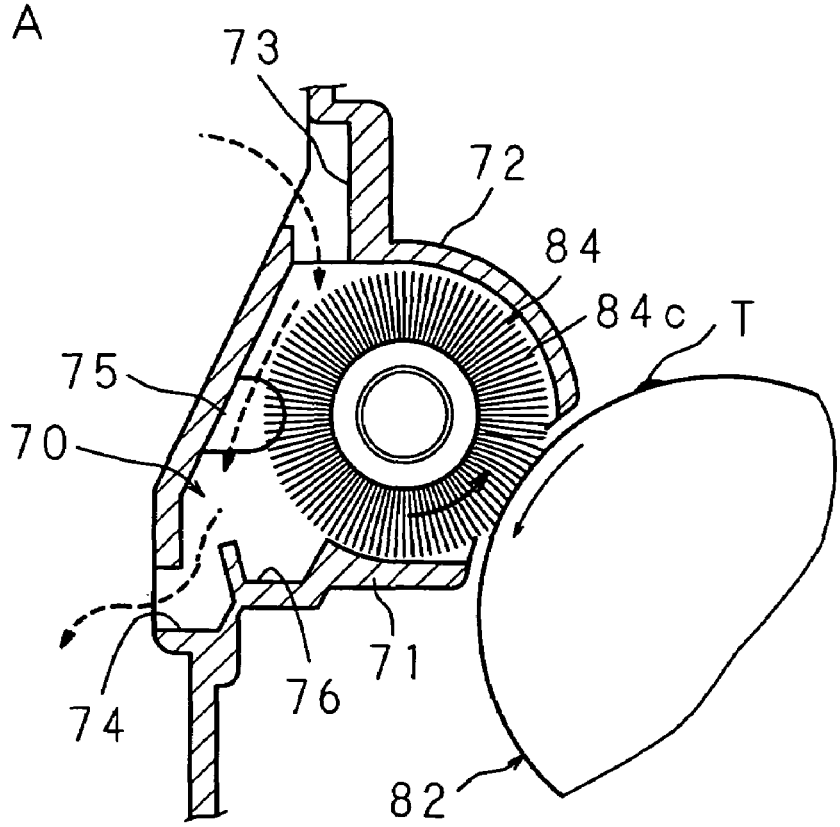
FIGS. 4A and 4B are fragmentary schematic cross-sectional views showing a toner collecting method in a cleaning unit.
Figure 4B:
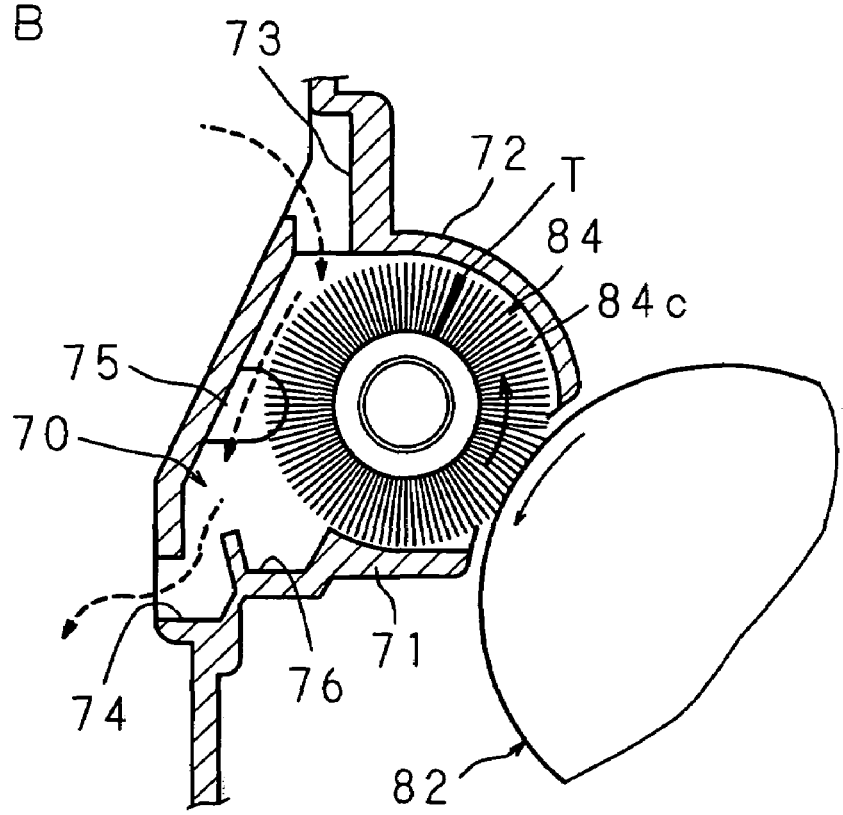

FIGS. 4A, 4B, 5A and 5B are fragmentary schematic cross-sectional views showing a toner collecting method in the cleaning unit 70. As already stated, the toner T stuck to the fixing roller 81 adheres to the pressure roller 82 via the fixing nip, and is carried along with the rotation of the pressure roller 82, to the contact interface with the cleaning roller 84 (Ref. FIG. 4A). The brush portion 84*c* of the cleaning roller 84 removes the toner from the pressure roller 82, and the brush portion 84*c* carries the toner T (Ref. FIG. 4B).

Figure 5A:
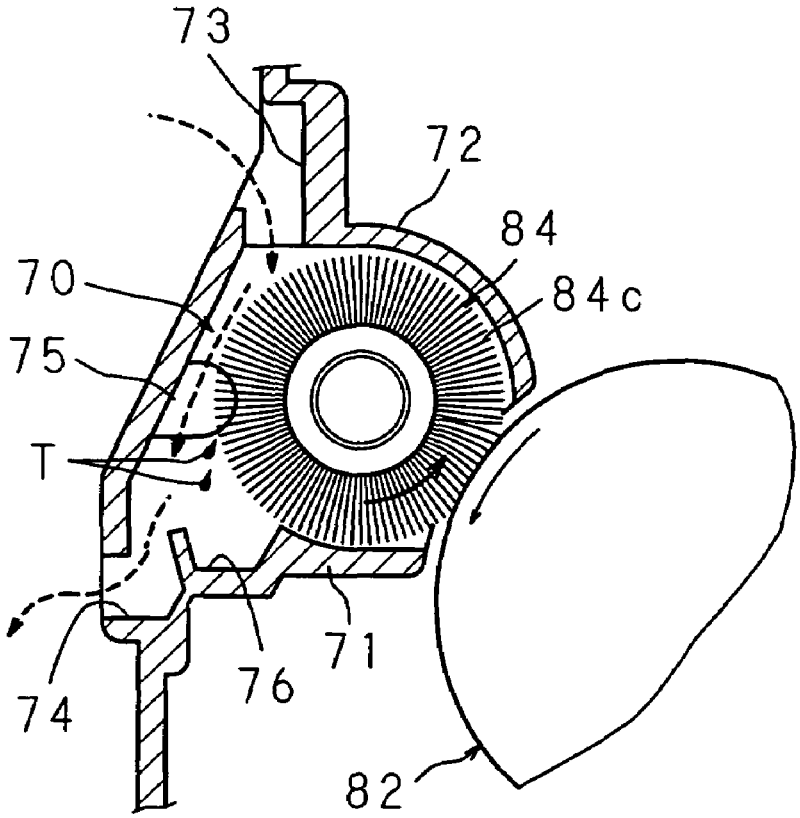
FIGS. 5A and 5B are fragmentary schematic cross-sectional views showing a toner collecting method in the cleaning unit.
Figure 5B:
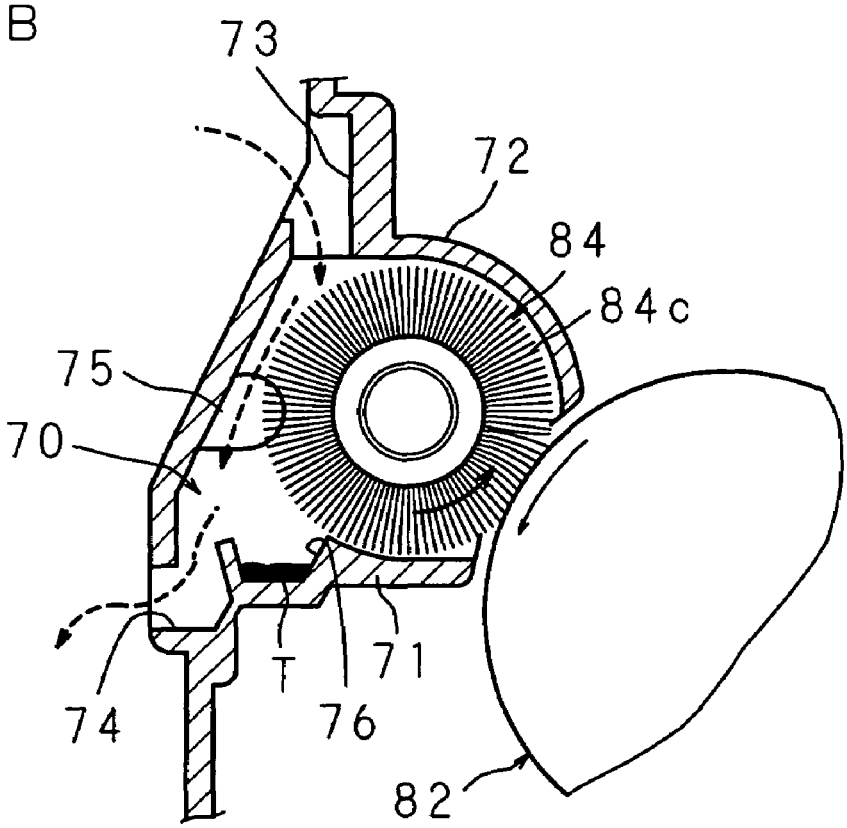

The toner T carried by the brush portion 84*c* reaches the contact point with the projection 75, by the rotation of the cleaning roller 84. The projection 75 removes the toner T from the brush portion 84*c*. In this embodiment, the ventilation ports 73 and 74 are provided at a higher and a lower position than the cleaning roller 84 respectively. Accordingly, when the cleaning roller 84 rotates in a direction indicated by the arrow in the drawings, air is caused to flow in a direction indicated by broken lines, inside the housing 80. Consequently, the toner T that has been removed does not adhere to the projection 75, but falls downward (Ref. FIG. 5A). This effect becomes more prominent, especially when the projection 75 has a fluorine coating on its surface. The toner T that has fallen down is collected into the receiving tray 76 located halfway of the air ventilating path (Ref. FIG. 5B).

Also, since the lower cover 71 is located close to the brush portion 84*c* in this embodiment, the toner T stuck to the brush portion 84*c* can be prevented from being carried toward the pressure roller 82 even when the toner T has not been completely removed by the projection 75, and the toner T is collected into the receiving tray 76 by the edge portion of the lower cover 71.

SECOND EMBODIMENT

While the receiving tray 76 is located inside the space delimited by the housing 80, the lower cover 71 and the upper cover 72 in the first embodiment, the receiving tray 76 does not necessarily have to be located inside the housing 80. The second embodiment, accordingly, represents a case where a toner collecting member is provided outside the housing 80.

Figure 6:
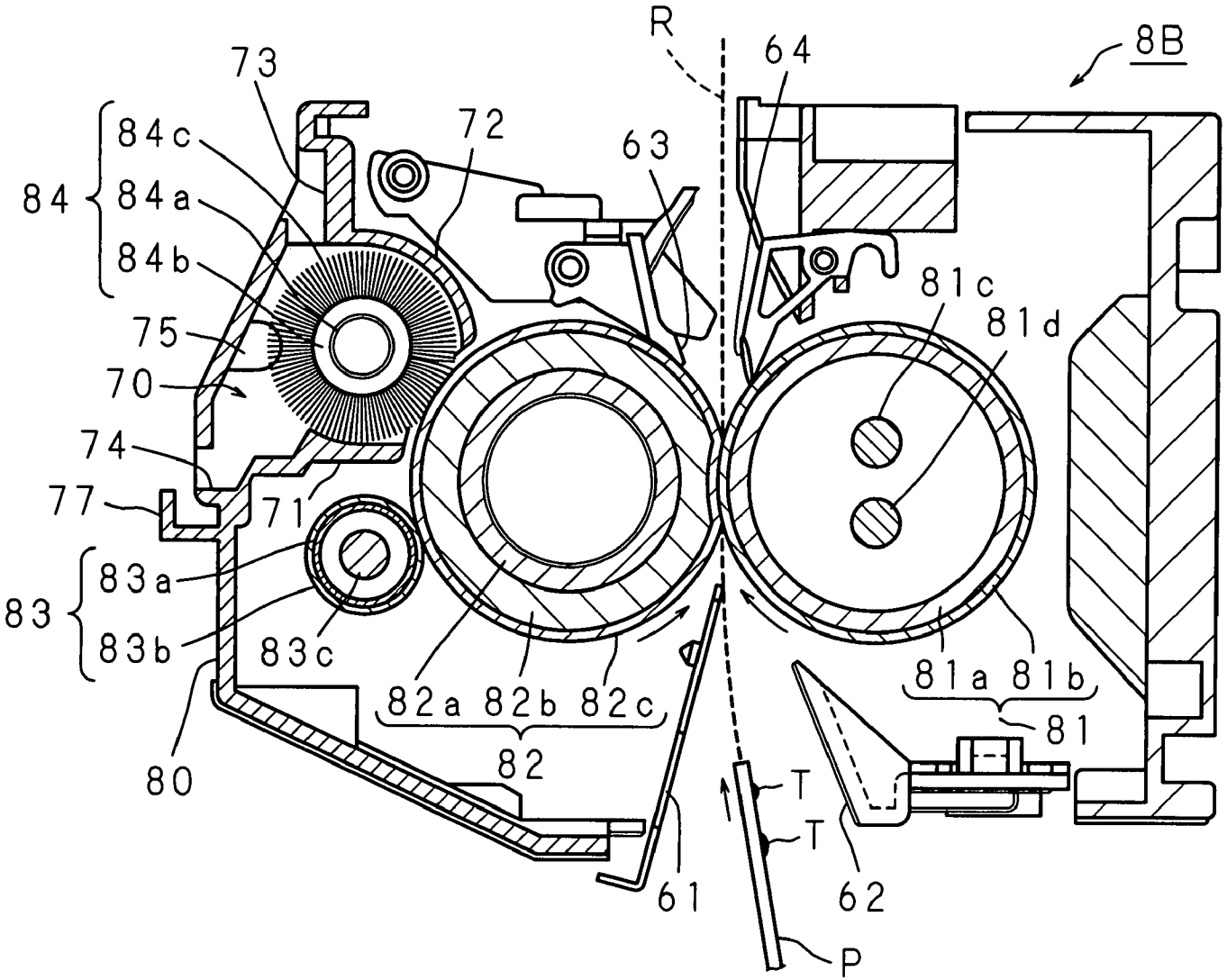
FIG. 6 is a schematic cross-sectional view showing a structure of a fixing unit according to a second embodiment of the present invention.

FIG. 6 is a schematic cross-sectional view showing a structure of a fixing unit 8B according to the second embodiment. Among the constituents of the fixing unit 8B shown in FIG. 6, the same constituents as those of the fixing unit 8A according to the first embodiment are given the identical numerals, and description thereof will be omitted. The fixing unit 8B according to this embodiment includes the fixing roller 81, the pressure roller 82, the external heating roller 83 and the cleaning unit 70, inside the housing 80.

The cleaning unit 70 includes a cleaning roller 84 that removes the toner stuck to the pressure roller 82, a projection 75 that removes the toner stuck to the cleaning roller 84, and a receiving tray 77 for collecting the toner removed by the projection 75. The cleaning roller 84 and the projection 75 are included in a space delimited by the housing 80, the lower cover 71 and the upper cover 72, as in the first embodiment. On the other hand, the receiving tray 77 is located outside the housing 80, and below the ventilation port 74. The toner removed by the projection 75 is collected into the receiving tray 77, by the air flow generated by the presence of the ventilation ports 73 and 74.

Such configuration makes the receiving tray 77 accessible from outside the housing 80, and hence allows collecting the toner and cleaning the receiving tray 77. When adopting such configuration, the receiving tray 77 may be removably attached to the housing 80.

THIRD EMBODIMENT

While the cleaning unit 70 is installed to remove the toner stuck to the pressure roller 82 in the first embodiment, the toner may also adhere to the fixing roller 81. Accordingly, a cleaning unit for removing the toner on the fixing roller 81 may be provided.

Figure 7:
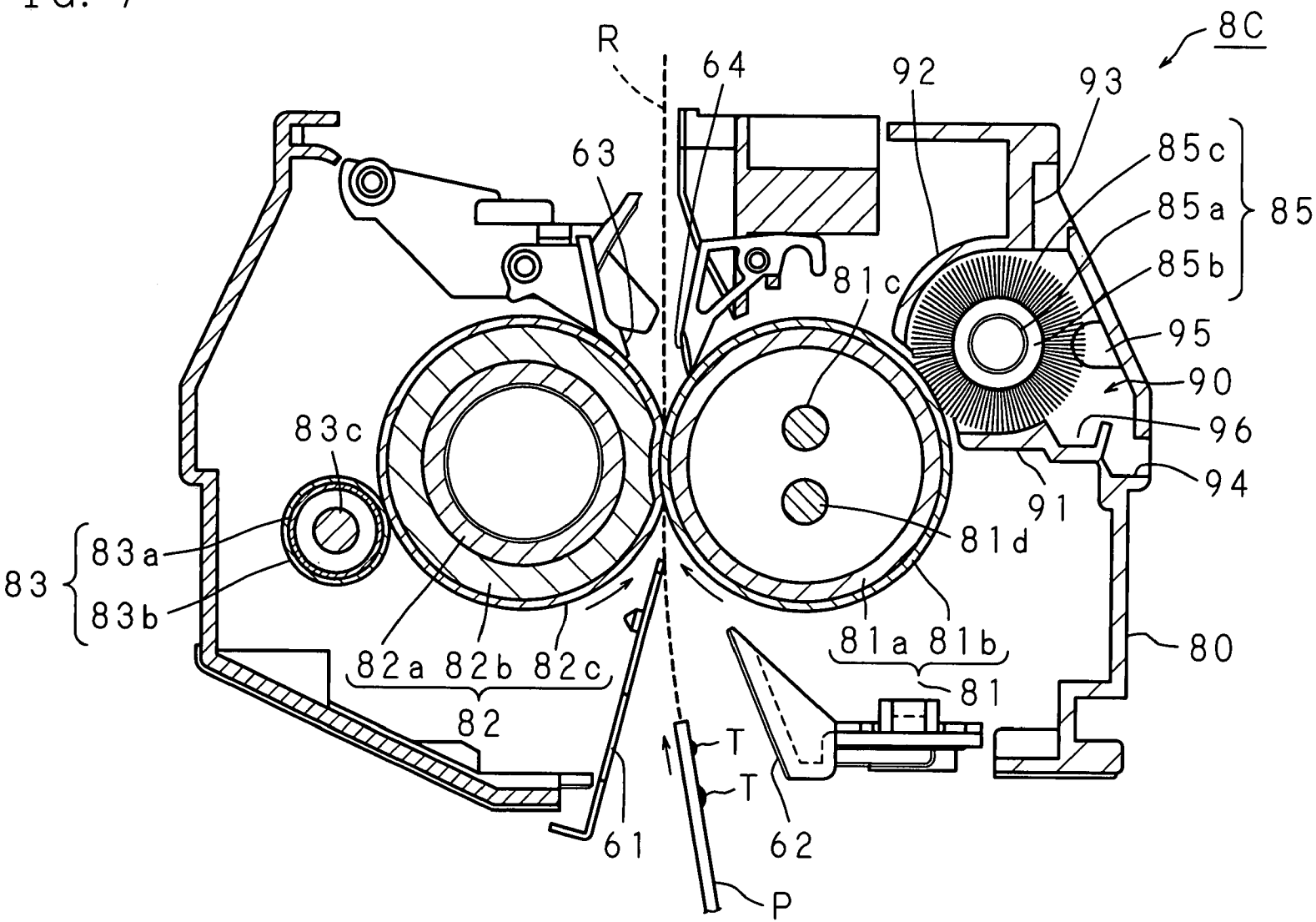
FIG. 7 is a schematic cross-sectional view showing a structure of a fixing unit according to a third embodiment of the present invention.

FIG. 7 is a schematic cross-sectional view showing a structure of a fixing unit 8C according to the third embodiment. Among the constituents of the fixing unit 8C shown in FIG. 7, the same constituents as those of the fixing unit 8A according to the first embodiment are given the identical numerals, and description thereof will be omitted. The fixing unit 8C according to this embodiment includes the fixing roller 81, the pressure roller 82, the external heating roller 83 and a cleaning unit 90, inside the housing 80.

The cleaning unit 90 includes a cleaning roller 85 that removes the toner stuck to the fixing roller 81, a projection 95 that removes the toner stuck to the cleaning roller 85, and a receiving tray 96 for collecting the toner removed by the projection 95. The cleaning roller 85, the projection 95 and the receiving tray 96 are located inside a space delimited by the housing 80, a lower cover 91 and an upper cover 92. Also, at appropriate positions on the housing 80 close to the cleaning roller 85, ventilation ports 93, 94 are perforated through the housing 80.

The cleaning roller 85 includes a core metal 85*a* disposed parallel to the rotation axis of the fixing roller 81, a cylindrical-shaped base material 85*b* fixed over the circumferential surface of the core metal 85*a*, and a brush portion 85*c* made of a flexible synthetic resin radially implanted on the circumferential surface of the base material 85*b*.

The cleaning roller 85 removes the toner stuck to the surface of the fixing roller 81. The toner thus stuck to the cleaning roller 85 is removed by the projection 95, and the toner removed from the cleaning roller 85 is collected into the receiving tray 96 by an air flow generated by the presence of the ventilation ports 93 and 94.

The first embodiment includes the cleaning unit 70 that removes the toner stuck to the pressure roller 82, while the second embodiment includes the cleaning unit 90 that removes the toner stuck to the fixing roller 81. It is, however, obviously possible to provide a plurality of cleaning units to remove both the toner stuck to the fixing roller 81 and the toner stuck to the pressure roller 82.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A fixing unit comprising:

a housing;

a fixing roller, which is provided inside the housing;

a pressure roller pressed against the fixing roller;

a fixing section for holding and conveying a sheet, which carries an image formed by a developer, between the fixing roller and the pressure roller so as to fix the image onto the sheet;

a removal section that removes an unfixed developer adhered to the fixing roller or the pressure roller; and an air vent located close to the removal section, wherein the removal section includes a contacting member, which is provided so as to contact with a circumferential surface of the fixing roller or the pressure roller, and a collection member that collects the unfixed developer adhered to the contacting member, and leads the developer to the collection member with an airflow passing through the air vent, and the collection member is located halfway along the vent path through which airflow passes.

2. The fixing unit according to claim 1, wherein the removal section further includes a member that removes the developer adhered to the contacting member.

3. The fixing unit according to claim 1, wherein the contacting member is a roller brush.

4. The fixing unit according to claim 3, further comprising a driving section that rotationally drives the roller brush.

5. The fixing unit according to claim 4, wherein the roller brush is rotated in a reverse direction to a rotating direction of the fixing roller or the pressure roller, with which the roller brush is in contact.

6. An image forming apparatus comprising:

a reception unit that receives image data;

a transfer unit that transfers the image formed by a developer based on the received image data; and the fixing unit according to claim 1, wherein the image transferred to the sheet by the transfer unit is fixed by the fixing unit for completing image forming.

* * * * *